US008007341B2

(12) United States Patent
Su

(10) Patent No.: US 8,007,341 B2
(45) Date of Patent: Aug. 30, 2011

(54) WHEEL ASSEMBLY FOR TOY CAR

(75) Inventor: Xiao-Guang Su, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 150 days.

(21) Appl. No.: 12/491,195

(22) Filed: Jun. 24, 2009

(65) Prior Publication Data

US 2010/0173563 A1 Jul. 8, 2010

(30) Foreign Application Priority Data

Jan. 7, 2009 (CN) ..... 2009 1 0300101

(51) Int. Cl.
*A63H 17/00* (2006.01)
*A63H 17/26* (2006.01)

(52) U.S. Cl. ..... 446/448; 446/431; 446/465

(58) Field of Classification Search ..... 446/431, 446/437, 448, 465; 301/45, 46, 48, 49, 51, 301/53

See application file for complete search history.

(56) References Cited

U.S. PATENT DOCUMENTS

| | | | | | |
|---|---|---|---|---|---|
| 193,680 | A | * | 7/1877 | Yale | 301/46 |
| 1,408,885 | A | * | 3/1922 | Humphrey | 301/46 |
| 2,032,293 | A | * | 2/1936 | Maxwell | 301/46 |
| 3,375,604 | A | * | 4/1968 | Alonso | 446/92 |
| 4,547,173 | A | * | 10/1985 | Jaworski et al. | 446/457 |
| 4,601,519 | A | * | 7/1986 | D'Andrade | 301/45 |
| 4,643,696 | A | * | 2/1987 | Law | 446/465 |
| 4,648,853 | A | * | 3/1987 | Siegfried | 446/448 |

* cited by examiner

*Primary Examiner* — Gene Kim
*Assistant Examiner* — Alyssa Hylinski
(74) *Attorney, Agent, or Firm* — Altis Law Group, Inc.

(57) ABSTRACT

A wheel assembly includes a shaft and a pair of wheels rotatably connected to opposite ends of the shaft. Each wheel includes an inner cover, an outer cover connected to the inner cover, and a steering member sandwiched between the inner cover and the outer cover. The steering member includes a motor, a rotating plate, at least two elastic elements equidistant from each other around the inner cover, and at least two pawls rotatably connected to the outer cover. The motor is fixed on the inner cover and includes a rotating shaft. The rotating plate is fixed to the rotating shaft and is driven by the motor to rotate. Each elastic element connects the rotating plate to each pawl. Each pawl extends out of the inner cover by rotation of the rotating plate, thereby changing the radius of the wheel.

10 Claims, 4 Drawing Sheets

WHEEL ASSEMBLY FOR TOY CAR

BACKGROUND

1. Technical Field

The present disclosure relates to wheel technology, and particularly, to a wheel assembly for a toy car.

2. Description of Related Art

Generally, complex wheel assembly is used to change the direction of moving vehicles. Such a wheel assembly typically includes steering mechanisms, such as struts, steering knuckle arms, etc. connected the front wheels and numerous controlling mechanisms for controlling the steering mechanisms to turn the wheels. However, this results in a bulky and complex wheel assembly for the toy car.

Therefore, what is needed is to provide a wheel assembly for a toy car, which can overcome the above-mentioned problem.

DETAILED DESCRIPTION

Figure 1:
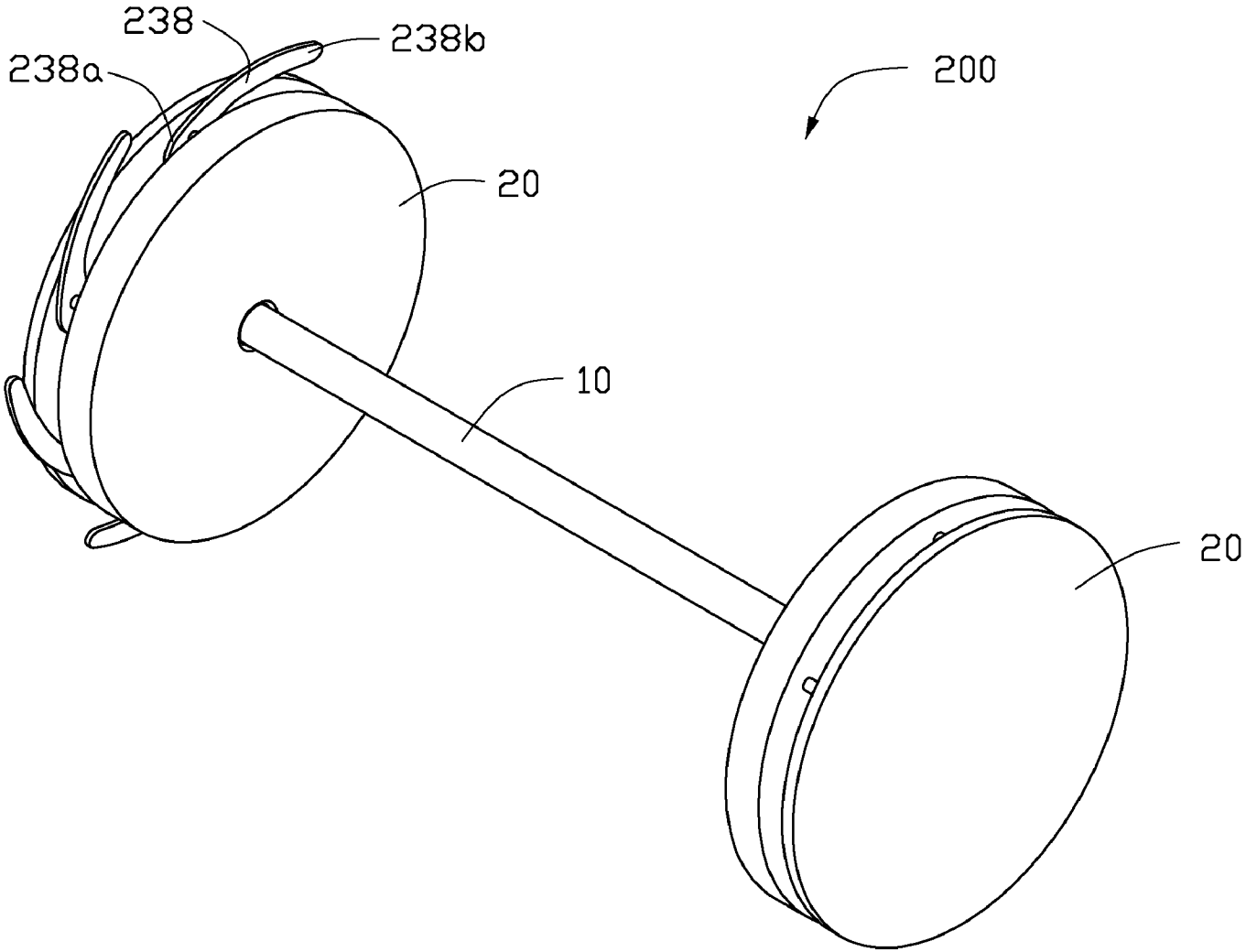
FIG. 1 is a schematic isometric view of a wheel assembly including a pair of wheels, according to a first embodiment.

Referring to FIG. 1, a wheel assembly 200 for a toy car (not shown), according to a first embodiment, includes a shaft 10 fixedly connected to the toy car, and a pair of wheels 20 rotatably connected to opposite ends of the shaft 10. The wheels 20 are driven by a driving assembly (not shown) to rotate about the shaft 10 in the toy car.

Figure 2:
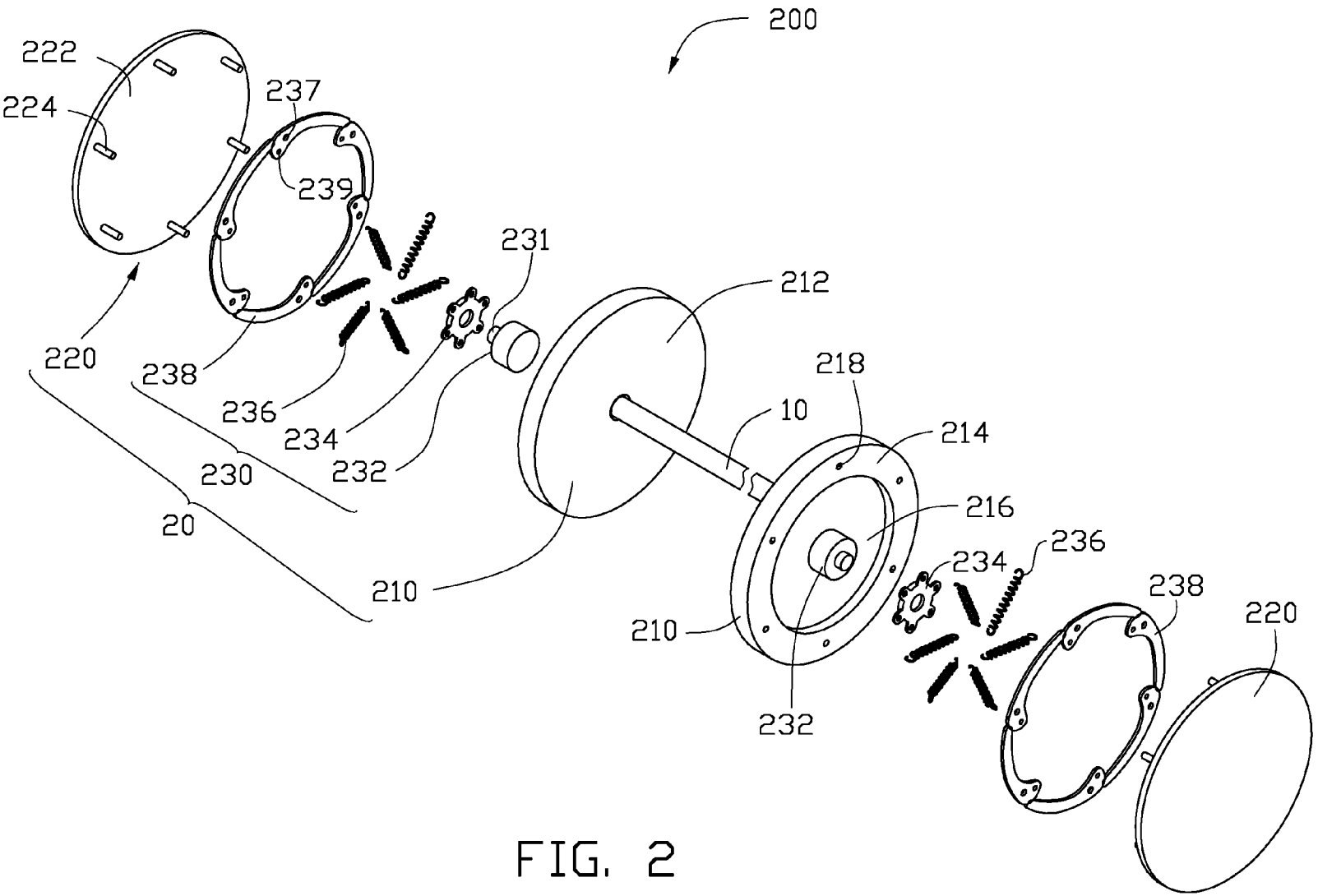
FIG. 2 is an exploded view of the wheel assembly of FIG. 1.
Figure 3:
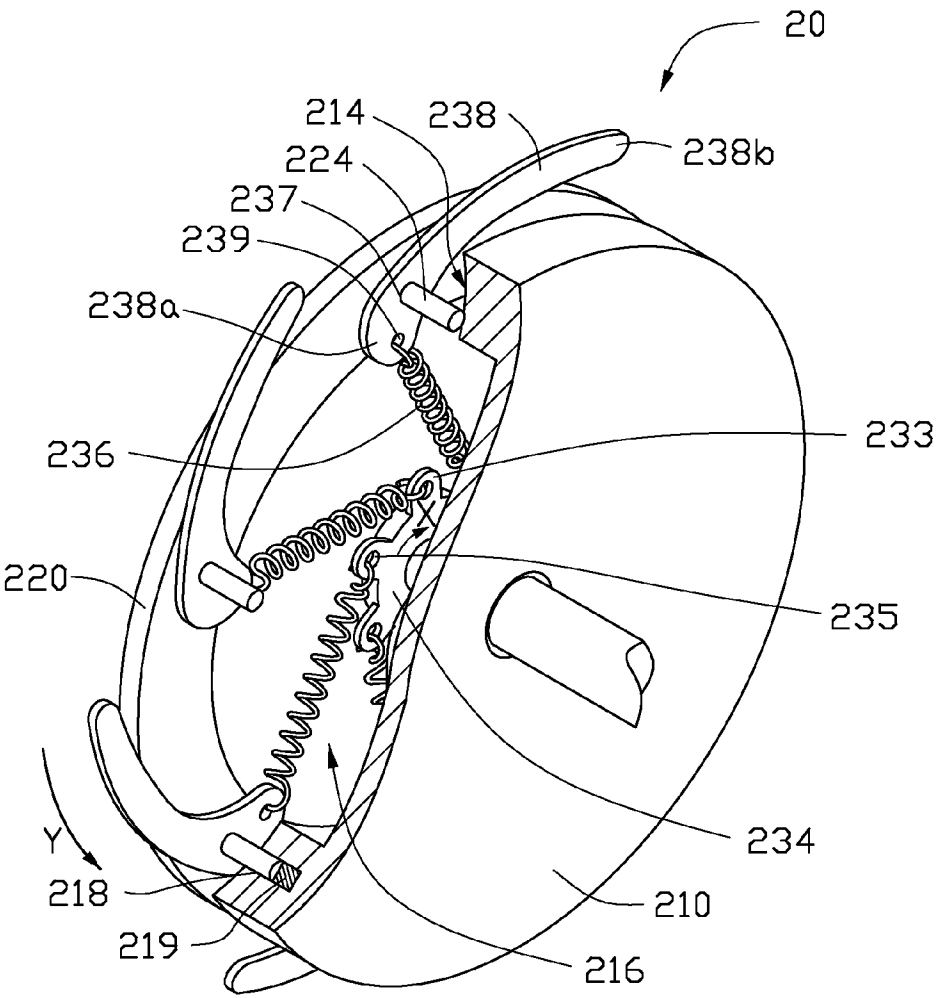
FIG. 3 is a cut-way view of one wheel of the wheel assembly of FIG. 1.

Referring to FIGS. 2 and 3, each wheel 20 includes a cylindrical inner cover 210, a cylindrical outer cover 220 connected to the inner cover 210, and a steering member 230 sandwiched between the inner cover 210 and the outer cover 220.

The inner cover 210 includes a first surface 212 and a second surface 214 opposite to the first surface 212. The inner cover 210 is rotatably connected to the shaft 10 at the center of the inner cover 210. A cylindrical groove 216 is defined on the second surface 214. Six blind holes 218 are defined on the second surface 214 around the groove 216 and are substantially equidistant from each other. Six magnets 219 are fixed in the blind holes 218.

The outer cover 220 includes a third surface 222 facing the second surface 214. Six magnetic posts 224 are formed on the third surface 222 corresponding to the six blind holes 218. Each magnetic post 224 is received in the corresponding blind hole 218 and is attracted by the corresponding magnet 219 so that the outer cover 220 is fixed to the inner cover 210 tightly. Each magnetic post 224 may be a post coated with a magnetic film thereon.

The steering member 230 includes a motor 232, a rotating plate 234, six elastic elements 236, and six pawls 238.

The motor 232 includes a rotating shaft 231 and is fixed in the groove 216. The motor 232 is controlled by a controller (not shown) in the toy car. The rotating plate 234 is fixed to the rotating shaft 231 and rotates with the rotating shaft 231. Six protrusions 233 extend from the circumference of the rotating plate 234 and are substantially equidistant from each other around the rotating shaft 231. A first through hole 235 is defined in each protrusion 233, with an axial direction of each first through hole 235 parallel to that of the rotating shaft 231.

Each pawl 238 includes a connecting end 238*a* and a supporting end 238*b* opposite to the connecting end 238*a*. A second through hole 237 corresponding to each magnetic post 224 and a third through hole 239 are defined in the connecting end 238*a* of each pawl 238. The second through hole 237 and the third through hole 239 are spaced from each other. Each pawl 238 passes through the corresponding second through hole 237 and sleeves each magnetic post 224. Therefore, the pawl 238 can rotate about the corresponding magnetic post 224.

In this embodiment, the elastic elements 236 are compression springs. One end of each elastic element 236 is connected to each pawl 238 through each third hole 239 correspondingly. The other end of each elastic element 236 is connected to each protrusion 233 through each first through hole 235 correspondingly. Therefore, the elastic element 236 connects the six pawls 238 to the rotating plate 234.

Referring to FIGS. 1-3, when the moving direction of the toy car is to be change, one of the motors 232 is controlled to drive the rotating plate 234 of one wheel 20 to rotate along a first direction X (FIG. 3) while the other motor 232 is off. Each pawl 238 is rotated about the magnetic post 224 along a reversed second direction Y by a pulling force applied by each elastic element 236. As a result, the pawls 238 extend out of the inner cover 210, increasing the radius of the wheel 20. Because the two wheels 20 have the same angular speed but different diameters, the wheel with the larger diameter will rotate about the wheel with the smaller diameter thereby changing the direction of the toy car. Therefore, the toy car having the wheel assembly 200 can change its direction without complex steering mechanisms and relative controlling mechanisms, and the wheel assembly 200 becomes compact and simple.

Figure 4:
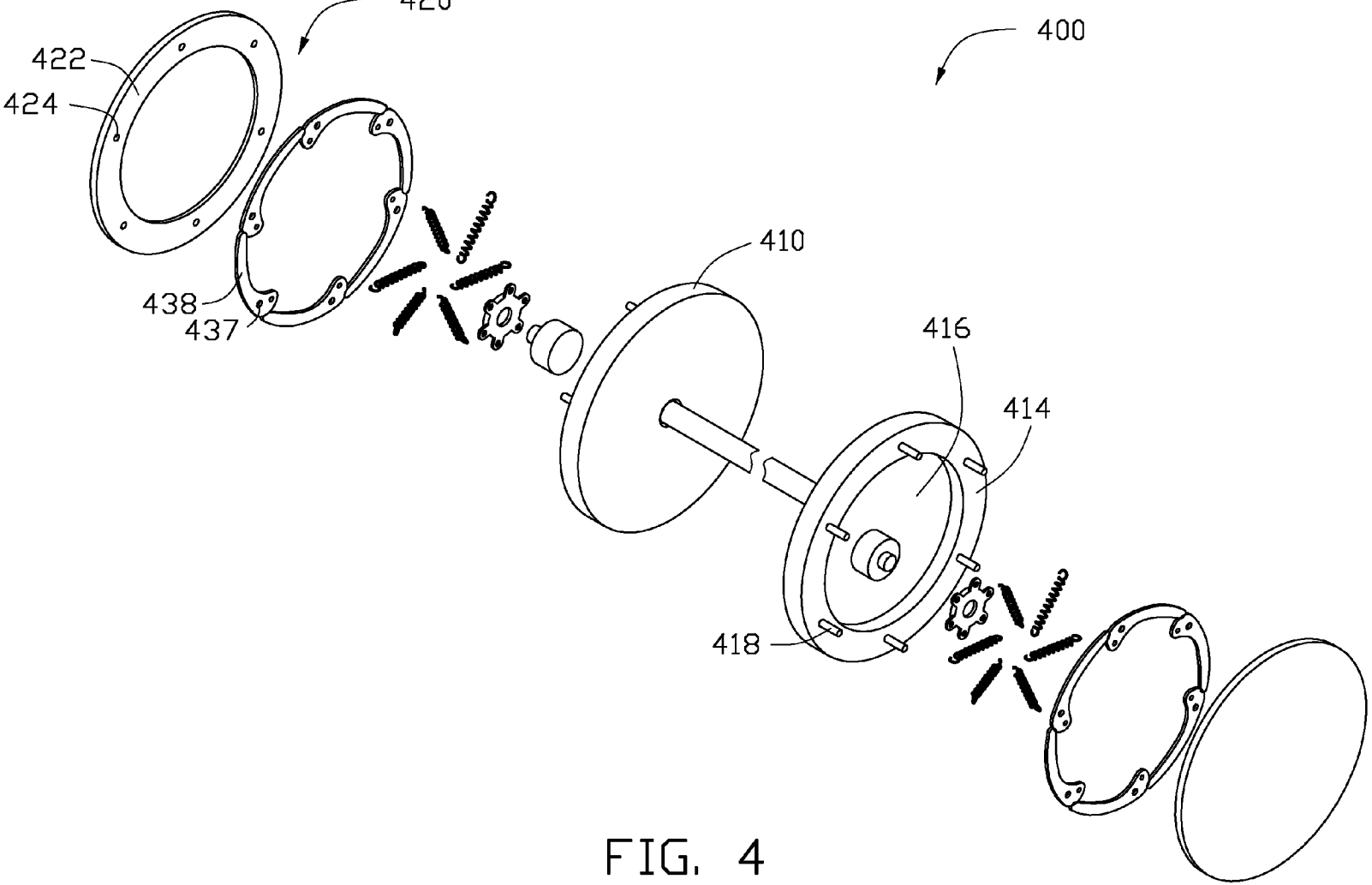
FIG. 4 is an exploded isometric view of a wheel assembly, according to a second embodiment.

Referring to FIG. 4 together with FIG. 2, a wheel assembly 400 according to a second embodiment is shown. The difference between the wheel assembly 400 of this embodiment and the wheel assembly 200 of the first embodiment is that a cylindrical inner cover 410 and a cylindrical outer cover 420 are different.

Six magnetic posts 418 are formed on the second surface 414 instead of formed on the third surface 422 and are substantially equidistant from each other around the groove 416. Six blind holes 424 are defined on the third surface 422 corresponding to the magnetic posts 418 instead of formed on the second surface 414. Each magnetic post 418 passes through the corresponding second through hole 437 and is tightly engaged in the corresponding blind hole 424 so that the outer cover 420 is fixed to the inner cover 410. Each pawl 438 rotatably sleeves each magnetic post 418 through the corresponding second through hole 437. Therefore, the pawl 438 can rotate about the corresponding magnetic post 418

Advantages of the second embodiment are similar to those of the first embodiment.

It is to be understood, however, that even though numerous characteristics and advantages of the present embodiments have been set fourth in the foregoing description, together with details of the structures and functions of the embodiments, the disclosure is illustrative only, and changes may be made in details, especially in matters of shape, size, and arrangement of parts within the principles of the invention to the full extent indicated by the broad general meaning of the terms in which the appended claims are expressed.

What is claimed is:

1. A wheel assembly comprising:

a shaft; and a pair of wheels rotatably connected to opposite ends of the shaft, each wheel comprising:

an inner cover;

an outer cover connected to and spaced away from the inner cover, thereby forming an annular open space between the outer cover and the inner cover; and a steering member sandwiched between the inner cover and the outer cover, the steering member comprising a motor, a rotating plate, at least two elastic elements equidistant from each other around the inner cover, and at least two pawls rotatably connected to the outer cover, the motor fixed on the inner cover and including a rotating shaft, the rotating plate fixed to the rotating shaft and driven by the motor to rotate about an axis that the rotating shaft rotates about, each elastic element connecting the rotating plate to each pawl, each pawl extending out of the annular open space by rotation of the rotating plate, thereby changing the radius of the wheel.

2. The wheel assembly as claimed in claim 1, wherein the inner cover and the outer cover are cylindrical, and the inner cover is rotatably connected to the shaft at the center of the inner cover.

3. The wheel assembly as claimed in claim 1, wherein the inner cover comprises a first surface and a second surface opposite to the first surface, the first surface is adjacent to the shaft, a cylindrical groove is defined on the second surface, and the motor is fixed in the groove.

4. The wheel assembly as claimed in claim 3, wherein at least two blind holes are defined on the second surface around the groove and are substantially equidistant from each other, the outer cover comprises a third surface facing the second surface, at least two magnetic posts are formed on the third surface corresponding to the at least two blind holes, and each magnetic post is engaged with each corresponding blind hole so that the outer cover is fixed to the inner cover.

5. The wheel assembly as claimed in claim 4, wherein the wheel assembly further comprises at least two magnets corresponding to the at least two magnetic posts and the at least two blind holes, each magnet is fixed in each corresponding blind hole, and each magnetic post is coated with a magnetic film.

6. The wheel assembly as claimed in claim 5, wherein at least two protrusions extend from the circumference of the rotating plate and are substantially equidistant from each other around the rotating shaft, a first through hole is defined in each protrusion, and one end of each elastic element is connected to each protrusion of the rotating plate through each first through hole.

7. The wheel assembly as claimed in claim 6, wherein each pawl comprises a connecting end, a second through hole is defined in the connecting end of each pawl, each magnetic post passes through the corresponding second through hole and is tightly engaged in the corresponding blind hole so that each pawl is rotatably connected to the corresponding magnetic post and the outer cover is fixed to the inner cover.

8. The wheel assembly as claimed in claim 7, wherein a third through hole is defined in the connecting end of each pawl and spaced from the second through hole, and the other end of each elastic element is connected to each pawl through each third through hole.

9. The wheel assembly as claimed in claim 1, wherein each elastic element is a compression spring.

10. The wheel assembly as claimed in claim 3, wherein at least two magnetic posts are formed on the second surface around the groove and are substantially equidistant from each other, the outer cover comprises a third surface facing the second surface, at least two blind holes are defined on the third surface corresponding to the at least two magnetic posts, and each magnetic post is engaged with each corresponding blind hole so that the outer cover is connected to the inner cover.

* * * * *